US010934817B2

(12) United States Patent
Sang et al.

(10) Patent No.: US 10,934,817 B2
(45) Date of Patent: Mar. 2, 2021

(54) SYSTEM FOR EXTRACTING GAS FROM TECTONICALLY-DEFORMED COAL SEAM IN-SITU BY DEPRESSURIZING HORIZONTAL WELL CAVITY

(71) Applicants: China University of Mining and Technology, Jiangsu (CN); XUZHOU OLIVINE GEOSCIENCE & GEOTECH CO., LTD, Jiangsu (CN)

(72) Inventors: Shuxun Sang, Jiangsu (CN); Shiqi Liu, Jiangsu (CN); Liwen Cao, Jiangsu (CN); Xiaozhi Zhou, Jiangsu (CN); Haiwen Wang, Shandong (CN); Huihu Liu, Anhui (CN); Zicheng Li, Hubei (CN); Huazhou Huang, Jiangsu (CN); Changjiang Liu, Shandong (CN); Hongjie Xu, Anhui (CN); Ran Wang, Jiangsu (CN); Jinlong Jia, Hubei (CN); Shuyun Zhu, Jiangsu (CN)

(73) Assignees: China University of Mining and Technology, Jiangsu (CN); XUZHOU OLIVINE GEOSCIENCE & GEOTECH CO., LTD, Jiangsu (CN)

( * ) Notice: Subject to any disclaimer, the term of this patent is extended or adjusted under 35 U.S.C. 154(b) by 0 days.

(21) Appl. No.: 16/960,023

(22) PCT Filed: Oct. 18, 2018

(86) PCT No.: PCT/CN2018/110868
§ 371 (c)(1),
(2) Date: Jul. 3, 2020

(87) PCT Pub. No.: WO2019/205516
PCT Pub. Date: Oct. 31, 2019

(65) Prior Publication Data

US 2020/0340335 A1 Oct. 29, 2020

(30) Foreign Application Priority Data

Apr. 28, 2018 (CN) ..... 201810404478.9

(51) Int. Cl.
*E21B 43/12* (2006.01)
*E21B 7/04* (2006.01)
(Continued)

(52) U.S. Cl.
CPC ..... *E21B 43/124* (2013.01); *E21B 7/046* (2013.01); *E21B 7/18* (2013.01); *E21B 10/32* (2013.01);
(Continued)

(58) Field of Classification Search
CPC ..... E21B 10/32; E21B 43/124; E21B 43/13
See application file for complete search history.

(56) References Cited

U.S. PATENT DOCUMENTS

2007/0062693 A1 3/2007 Chan et al.
2017/0145794 A1 5/2017 Lin et al.

FOREIGN PATENT DOCUMENTS

CN 102518411 6/2012
CN 102536302 7/2012
(Continued)

OTHER PUBLICATIONS

"International Search Report (Form PCT/ISA/210)" of PCT/CN2018/110868, dated Jan. 25, 2019, with English translation thereof, pp. 1-4.

*Primary Examiner* — Kristyn A Hall
(74) *Attorney, Agent, or Firm* — JCIPRNET

(57) ABSTRACT

A system for extracting gas from a tectonically-deformed coal seam in-situ by depressurizing a horizontal well cavity is provided. A horizontal well is constructed by a horizontal well drilling and reaming subsystem and adjoins a vertical well to form a U-shaped well, and a horizontal section of the horizontal well is reamed to enlarge hole diameter. A horizontal well hole-collapse cavity-construction depressurization excitation subsystem performs pressure-pulse excitation and stress release on the horizontal well of tectonically-deformed coal bed methane, and hydraulically displaces a coal-liquid-gas mixture such that the mixture is conveyed towards a vertical well section along a depressurizing space. A product lifting subsystem further pulverizes the coal and lifts the mixture towards a wellhead of a vertical well. A
(Continued)

gas-liquid-solid separation subsystem separates the coal, liquid and gas. A monitoring and control subsystem detects and controls the operation conditions and the execution processes of technical equipment in real time.

6 Claims, 3 Drawing Sheets

(51) Int. Cl.

| | |
|---|---|
| ***E21B 7/18*** | (2006.01) |
| ***E21B 10/32*** | (2006.01) |
| ***E21B 15/04*** | (2006.01) |
| ***E21C 41/18*** | (2006.01) |
| ***E21F 17/18*** | (2006.01) |

(52) U.S. Cl.
CPC ..... *E21B 15/04* (2013.01); *E21B 43/126* (2013.01); *E21C 41/18* (2013.01); *E21F 17/18* (2013.01)

(56) References Cited

FOREIGN PATENT DOCUMENTS

| | | |
|---|---|---|
| CN | 105736039 | 7/2016 |
| CN | 107762451 | 3/2018 |

SYSTEM FOR EXTRACTING GAS FROM TECTONICALLY-DEFORMED COAL SEAM IN-SITU BY DEPRESSURIZING HORIZONTAL WELL CAVITY

CROSS-REFERENCE TO RELATED APPLICATION

This application is a 371 of international application of PCT application serial no. PCT/CN2018/110868, filed on Oct. 18, 2018, which claims the priority benefit of China application no. 201810404478.9, filed on Apr. 28, 2018. The entirety of each of the above mentioned patent applications is hereby incorporated by reference herein and made a part of this specification.

BACKGROUND OF THE INVENTION

Field of the Invention

The present invention relates to the field of coal bed methane extraction, and relates to a system for coal bed methane extraction, and in particular, to a system for extracting gas from a tectonically-deformed coal seam in-situ by depressurizing a horizontal well cavity.

Description of Related Art

Tectonically-deformed coal refers to coal whose coal seam is subject to tectonic stress and whose primary structure and construction are significantly destroyed due to cracking, resulting in fractures, wrinkles, polished surfaces, and other structural changes. The extensive development of tectonically-deformed coal and the richness of tectonically-deformed coal bed methane (referred to as CBM) resources are distinguishing features of coal and coal bed methane resources in China. Tectonically-deformed coal resources account for a very high proportion of coal resources that have been discovered in China, and a proportion of a quantity of tectonically-deformed coal bed methane resources to a total quantity of coal bed methane resources in China is larger. Tectonically-deformed coal has prominent features such as rich gas, low permeability, and looseness, and most of tectonically-deformed coal are coal and gas outburst coal seams. Due to its hazards and difficulty in extraction and utilization, the tectonically-deformed coal is mostly discharged into the atmosphere in coal production. The efficient development of tectonically-deformed coal bed methane is of great significance for energy, safety and ecology.

A method based on the theory of hydrophobic depressurization, desorption, and gas recovery is a main method for the development of surface wells for in-situ coal bed methane at present. Due to the extremely low permeability of tectonically-deformed coal reservoirs and the poor effect of a reconstruction method such as hydraulic fracturing, the theory of hydrophobic depressurization, desorption, and gas recovery is not suitable for tectonically-deformed coal reservoirs. The results of exploration and development practice also show that all coal bed methane exploration and development technologies based on the theory of hydrophobic depressurization, desorption, and gas recovery, including SVR technologies (vertical well fracturing, U-shaped well fracturing, multi-branched horizontal well fracturing, horizontal well fracturing, and the like), ECBM technologies ($CO_2$-ECBM, $N_2$-ECBM, and the like) and their combined technologies, fail to achieve efficient development of tectonically-deformed coal bed methane. Therefore, efficient exploration and development technologies and equipment for tectonically-deformed coal bed methane have become one of important technical bottlenecks restricting the rapid and scale development of the China's coal bed methane industry.

With the in-depth study of coal bed methane extraction technologies, the development theory of mining-induced pressure relief and permeability improvement for tectonically-deformed coal bed methane in a protected layer in a coal mine area provides a new idea for in-situ extraction of tectonically-deformed coal bed methane. However, in actual extraction application, due to the characteristics of tectonically-deformed coal, there are problems such as wellbore fractures caused by overburden deformation and difficulty in connecting coal to coal bed methane production. Therefore, the research and development of a technical theory and technical equipment that are suitable for in-situ extraction of tectonically-deformed coal bed methane is an important theoretical and practical way to break the technical bottleneck of efficient development of surface wells for tectonically-deformed coal bed methane in China and realize the exploration and development of coal bed methane in China.

SUMMARY OF THE INVENTION

To resolve the foregoing problem, the present invention provides a system for extracting gas from a tectonically-deformed coal seam in-situ by depressurizing a horizontal well cavity, to enable the completion of a large-diameter horizontal well in a loose tectonically-deformed coal reservoir, horizontal well cavity-constructing stress release, effective lifting of mixed fluids, and efficient separation of produced mixtures, thereby achieving efficient and continuous in-situ extraction of tectonically-deformed coal bed methane.

To achieve the foregoing objective, the present invention adopts the following technical solution: a system for extracting gas from a tectonically-deformed coal seam in-situ by depressurizing a horizontal well cavity. The system comprises a horizontal well drilling and reaming subsystem, a horizontal well hole-collapse cavity-construction depressurization excitation subsystem, a product lifting subsystem, a gas-liquid-solid separation subsystem, and a monitoring and control subsystem. The horizontal well drilling and reaming subsystem includes a drill tower, a drilling rig, a drill column string, a drilling tool, and a drilling fluid circulation system. The drilling tool, from a connection end with the drill column string to a drilling end, includes a third-stage reaming and retraction assembly, a primary and secondary reaming and retraction assembly, and a pilot assembly respectively. The third-stage reaming and retraction assembly includes a plurality of expandable and closable blades that is circumferentially disposed. The blade is locked and positioned by a second locking mechanism. The primary and secondary reaming and retraction assembly includes a plurality of extendable and retractable plunger drill bits that is circumferentially disposed. The plunger drill bit is locked and positioned by a first locking mechanism.

The horizontal well hole-collapse cavity-construction depressurization excitation subsystem includes a ground power unit and an underground injection device. An inlet of the ground power unit is in communication with a liquid storage tank, and an outlet of the ground power unit is in communication with the underground injection device. The underground injection device is disposed at one side of a depressurization cavity in a horizontal well near the drill tower.

The product lifting subsystem includes a pulverization disturbance device and a hydraulic jet pump. The hydraulic jet pump is a wide-flow jet pump and disposed in a vertical well near the bottom of the well. The pulverization disturbance device is disposed between the depressurization cavity and the vertical well.

The gas-liquid-solid separation subsystem includes a coal-liquid-gas separation device and a coal-liquid separation device. An inlet of the coal-liquid-gas separation device is in communication with a wellhead pipeline of the vertical well, and two outlets of the coal-liquid-gas separation device are in communication with a gas storage tank and the coal-liquid separation device respectively. Two outlets of the coal-liquid separation device are in communication with a coal powder collection tank and the liquid storage tank respectively.

The monitoring and control subsystem includes three layers of network architecture and software including on-site workstations, monitoring instruments and sensors, and a central server control system, and is configured to detect and control the operation conditions and the execution processes of technical equipment in real time, so as to collect, display, process, and analyze engineering data.

Further, the horizontal well hole-collapse cavity-construction depressurization excitation subsystem further includes an abrasive mixing device. An inlet of the abrasive mixing device is in communication with the liquid storage tank and an abrasive tank, and an outlet of the abrasive mixing device is in communication with the inlet of the ground power unit.

Further, the blade on the drilling tool is rotated and opened towards the direction of the drill tower. A drilling fluid outlet is disposed on the right of the blade, and gradually inclines towards the direction of the blade when extending towards the outer circumference of the drilling tool from an inner cavity of the drilling tool.

Further, pumps in the extraction system are all integrated in a pump group except for the hydraulic jet pump.

In the present invention, the drilling tool in the horizontal well drilling and reaming subsystem is designed into a three-stage drilling and reaming tool; and further reaming is implemented through two-way reciprocating drilling construction after drilling in the horizontal section of the horizontal well. In this way, the diameter of the horizontal section is greatly increased, the problem of wellbore collapse induced by overburden deformation resulting from the loose tectonically-deformed coal is avoided, and continuous in-situ extraction of tectonically-deformed coal bed methane is ensured.

After completing the open-hole cavity-construction through reaming of the horizontal well, the high-pressure and high-speed fluids are injected into the horizontal well cavity at a particular pulse frequency to further cut and pulverize the medium, to implement the pressure-pulse excitation and the stress release on the horizontal well of the tectonically-deformed coal bed methane, and hydraulically displace the coal-liquid-gas mixture such that the mixture is conveyed towards the vertical well section along the depressurizing space. In this way, subsequent lifting is ensured.

The coal powder is further pulverized and the mixture is lifted towards the wellhead of the vertical well through cooperation of the underground pulverization disturbance device and the hydraulic jet pump; and efficient coal-liquid-gas separation for the produced mixture and recycling of the excitation liquid are achieved through the coal-liquid-gas separation device and the coal-liquid separation device.

Real-time detection and control of the operation conditions and the execution processes of the technical equipment are implemented through three layers of network architecture and software including on-site workstations, monitoring instruments and sensors, and a central server control system, so as to collect, display, process, and analyze the engineering data. The coordinated operation of subsystems in the entire extraction system achieves efficient and continuous in-situ extraction of the tectonically-deformed coal bed methane.

In the figures: 1: Drill tower; 2: Pump group; 3: Liquid storage tank; 4: Coal-liquid separation device; 5: Coal-liquid-gas separation device; 6: Gas storage tank; 7: Vertical well; 8: Hydraulic jet pump; 9: Depressurization cavity; 10: Drilling tool; 10-1: Pilot assembly; 10-2: Primary and secondary reaming and retraction assembly; 10-3: Third-stage reaming and retraction assembly; 10-4: Plunger drill bit; 10-5: Blade; 10-6: Second locking mechanism; 10-7: First locking mechanism; 10-8: Drilling fluid outlet; 11: Horizontal well; 12: Coal powder collection tank; 13: Abrasive tank; 14: Abrasive mixing device; 15: Ground power unit; and 16: Underground injection device.

DETAILED DESCRIPTION OF THE EMBODIMENTS

The present invention is further described below with reference to the accompanying drawings (a left-right direction in the following description is the same as a left-right direction in FIG. 1).

Figure 1:
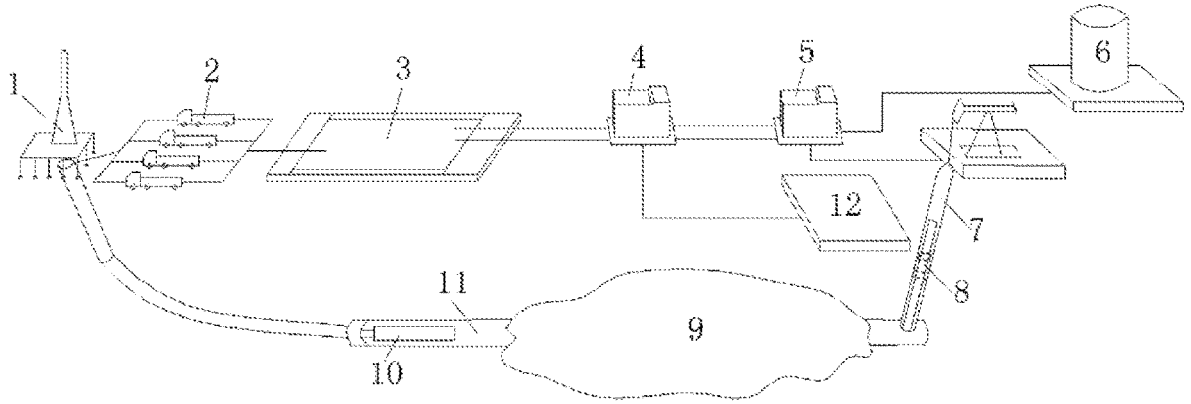
FIG. 1 is a schematic diagram of a system of the present invention.
Figure 2A:
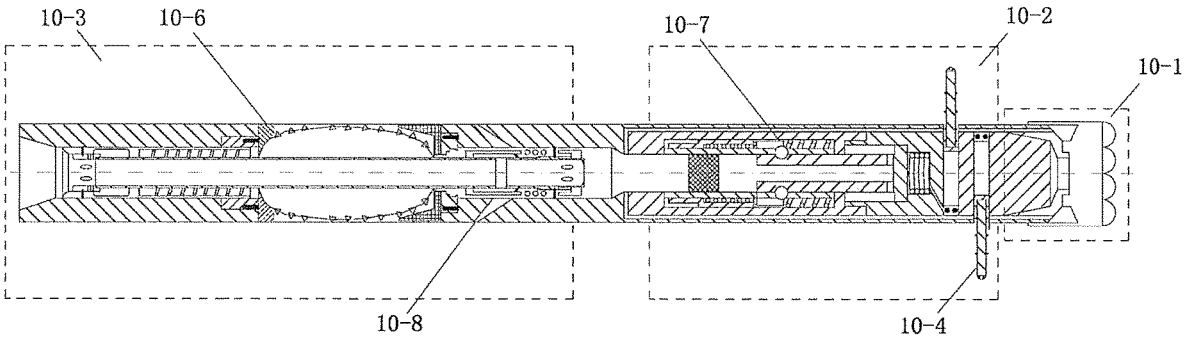
FIG. 2 is a schematic structural diagram of a drilling tool in the present invention, wherein (a) of FIG. 2 is a schematic state diagram of drilling of the drilling tool and (b) of FIG. 2 is a schematic state diagram of reaming of the drilling tool.
Figure 2B:
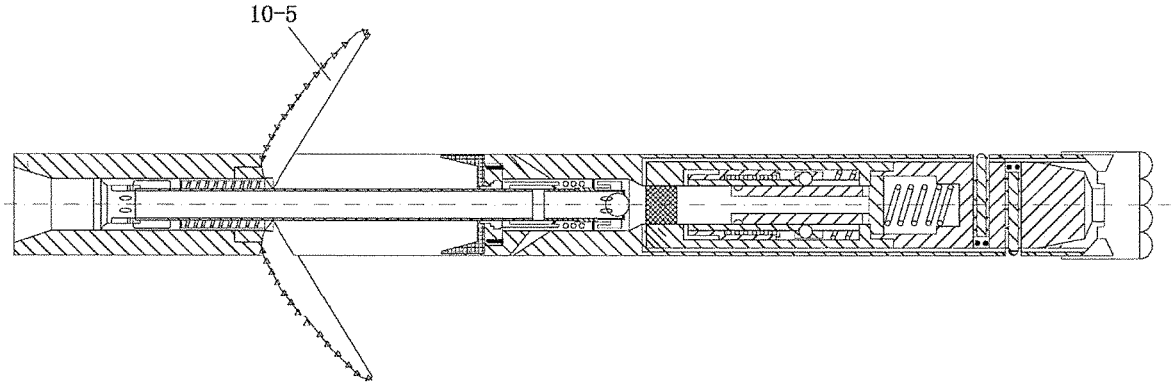
Figure 3:
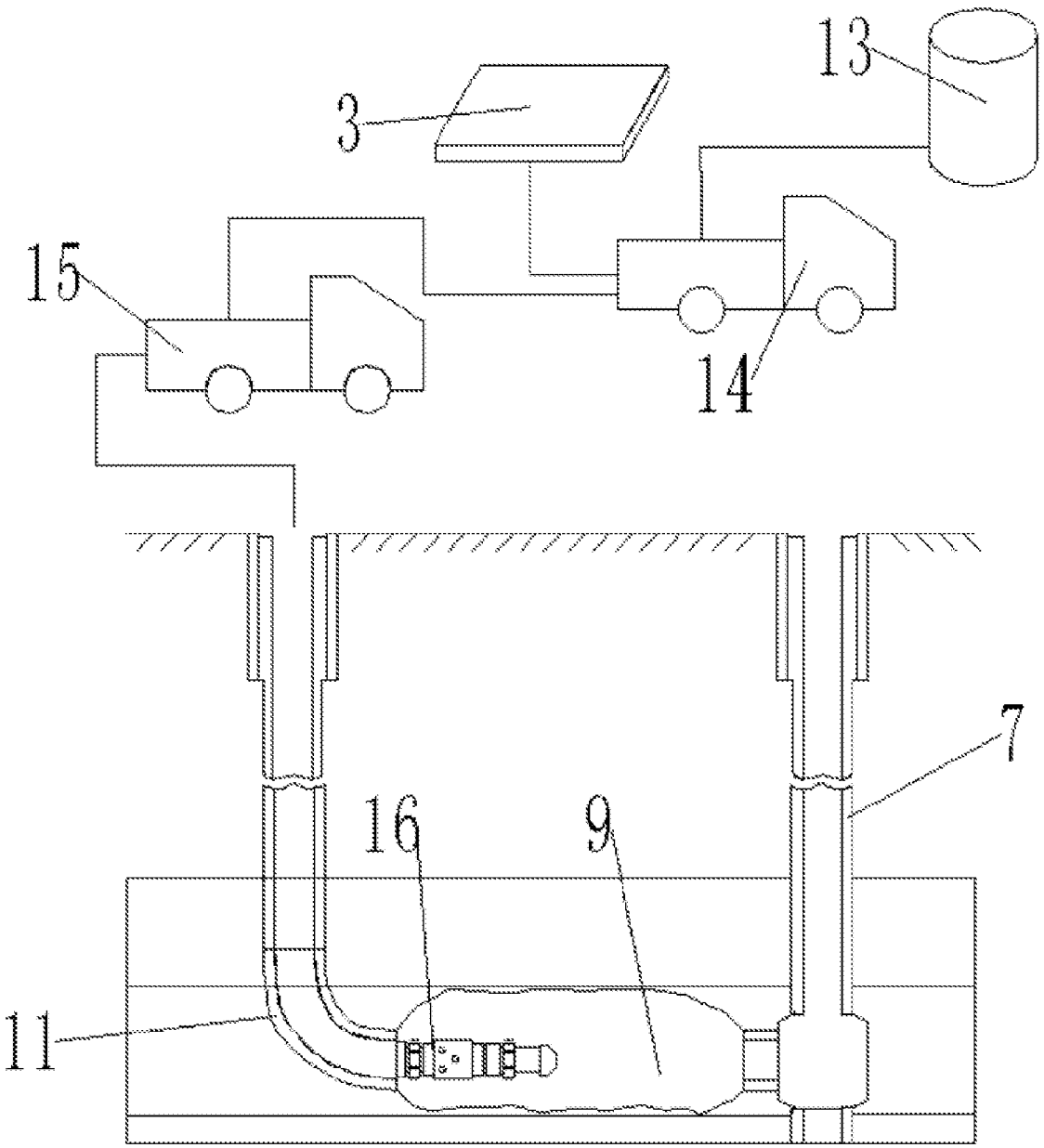
FIG. 3 is a schematic diagram of a depressurization excitation subsystem of the present invention.

FIG. 1 to FIG. 3 show a system for extracting gas from a tectonically-deformed coal seam in-situ by depressurizing a horizontal well cavity that is used in the present invention, which includes a horizontal well drilling and reaming subsystem, a horizontal well hole-collapse cavity-construction depressurization excitation subsystem, a product lifting subsystem, a gas-liquid-solid separation subsystem, and a monitoring and control subsystem. The horizontal well drilling and reaming subsystem includes a drill tower 1, a drilling rig (not shown), a drill column string (not shown), a drilling tool 10, and a drilling fluid circulation system. Connections between the drill tower 1, the drilling rig, and the drill column string are the same as those in the prior art. The drill tower 1 is configured to place and suspend a lifting system, bear the weight of the drilling tool, store a drill pipe and a drill collar, and so on. The drilling rig is configured to power the drilling tool 10. The drill column string is a string consisting of a Kelly bar, a drill pipe, a drill collar, and another underground tool, and is configured to install the drilling tool 10. The drilling tool 10, from a connection end with the drill column string to a drilling end, includes a third-stage reaming and retraction assembly 10-3, a primary and secondary reaming and retraction assembly 10-2, and a pilot assembly 10-1 respectively. The third-stage reaming and retraction assembly 10-3 includes a plurality of expandable and closable blades 10-5 that is circumferentially disposed. The blade 10-5 is locked and positioned by a second locking mechanism 10-6. The primary and secondary reaming and retraction assembly 10-2 includes a plurality of extendable and retractable plunger drill bits 10-4 that is circumferentially disposed. The plunger drill bit 10-4 is locked and positioned by a first locking mechanism 10-7. A connection between a drilling fluid positive circulation system and another component is the same as that in the prior art. During drilling construction of a horizontal well 11, during running towards the direction of a vertical well 7, the plunger drill bit 10-4 is extended to start drilling, and during returning towards the direction of the drill tower 1, the blade 10-5 is opened. Because the diameter after the blade 10-5 is opened is greater than the diameter when the plunger drill bit 10-4 is extended, the horizontal well is reamed, thereby achieving three-stage reaming in rock mass at drillability classes I, II, III, IV and V. Three-stage reaming rates respectively reach 150%, 200%, 300%, and a diameter increase after reaming is 200% to 300%.

The horizontal well hole-collapse cavity-construction depressurization excitation subsystem includes a ground power unit 15 and an underground injection device 16. An inlet of the ground power unit 15 is in communication with a liquid storage tank 3, and an outlet of the ground power unit 15 is in communication with the underground injection device 16. The underground injection device 16 is disposed at one side of a depressurization cavity 9 in the horizontal well 11 near the drill tower 1. After completing the open-hole cavity-construction through reaming of the horizontal well 11, a booster pump in the ground power unit 15 injects high-pressure and high-speed fluids to a horizontal well cavity at a particular pulse frequency, which are sprayed by the underground injection device 16 to the depressurization cavity 9, to implement pressure-pulse excitation and stress release on the horizontal well of tectonically-deformed coal bed methane; and a gas-liquid-coal mixture is displaced through the injected high-pressure and high-speed fluids such that the mixture is conveyed towards the vertical well 7 along a depressurizing space and then produced. A depressurization excitation range (a stress release area width/a coal thickness) after the pressure-pulse excitation and the stress release are performed on the horizontal well is ≥15.

The product lifting subsystem includes a pulverization disturbance device and a hydraulic jet pump 8. The hydraulic jet pump 8 is a wide-flow jet pump, is disposed in the vertical well 7 near the bottom of the well, and is configured to lift the gas-liquid-coal mixture to a wellhead. The pulverization disturbance device is disposed between the depressurization cavity 9 and the vertical well 7 for pulverizing coal powder at the bottom of the well, so that the coal powder can be more easily lifted by the hydraulic jet pump 8 to the wellhead of the vertical well 7. In this way, fluids with coal powder concentration ≤50% are efficiently produced.

The gas-liquid-solid separation subsystem includes a coal-liquid-gas separation device 5 and a coal-liquid separation device 4. An inlet of the coal-liquid-gas separation device 5 is in communication with a wellhead pipeline of the vertical well 7, and two outlets of the coal-liquid-gas separation device 5 are in communication with a gas storage tank 6 and the coal-liquid separation device 4 respectively. Two outlets of the coal-liquid separation device 4 are in communication with a coal powder collection tank 12 and the liquid storage tank 3 respectively. The subsystem can achieve gas-liquid-coal mixture pre-treating, gas separation, liquid-coal separation, coal-gas collection, excitation liquid (or water) purification and recycling, with gas separation efficiency of above 90% to 95%, excitation liquid separation and collection efficiency of above 80% to 90%, and a coal powder collection capability of above 98%. The main function is to achieve preliminary separation of gas, liquid, and coal powder through the coal-liquid-gas separation device 5 and the coal-liquid separation device 4. The separated coal and gas respectively enter the coal powder collection tank 12 and the gas storage tank 6 for storage, and the treated excitation liquid enters the liquid storage tank 3 for recycling, to ensure continuous extraction.

The monitoring and control subsystem includes three layers of network architecture and software including on-site workstations, monitoring instruments and sensors, and a central server control system. Based on a high-precision sensor technology, through construction of the three layers of network architecture including the sensors, the on-site workstations, and the central server control system, and application of configuration analysis software and an Internet of Things perception technology, a data acquisition and monitoring system that is "accurate, visual, interactive, fast, and intelligent" is formed to detect and control the operation conditions and the execution processes of technical equipment in real time, so as to collect, display, process, and analyze engineering data.

The horizontal well hole-collapse cavity-construction depressurization excitation subsystem further includes an abrasive mixing device 14. An inlet of the abrasive mixing device 14 is in communication with the liquid storage tank 3 and an abrasive tank 13, and an outlet of the abrasive mixing device 14 is in communication with the inlet of the ground power unit 15. The addition of a particular proportion of an abrasive to the excitation liquid improves the capability of the excitation liquid to cut a coal rock, thereby improving extraction efficiency.

The blade 10-5 on the drilling tool 10 is rotated and opened towards the direction of the drill tower 1. A drilling fluid outlet 10-8 is disposed on the right of the blade 10-5, and gradually inclines towards the direction of the blade 10-5 when extending towards the outer circumference of the drilling tool 10 from an inner cavity of the drilling tool 10. During drilling, drilling fluids can achieve cooling and auxiliary cutting functions like conventional drilling fluids, and can also provide sufficient support for the expansion of the blade 10-5, to reduce rigid deformation of a connecting member with the blade 10-5, and prolong a service life of the device.

Pumps in the extraction system are all integrated in a pump group 2 except for the hydraulic jet pump 8, which is convenient for communication with the liquid storage tank 3 and underground equipment pipelines, thereby reducing the complexity of connections between the devices in the extraction system.

A method of extracting gas from a tectonically-deformed coal seam in-situ by depressurizing a horizontal well cavity includes the following steps:

1) arranging various devices on the ground and connecting the corresponding devices, and using an existing drilling device and processing technology to construct vertical well sections and kick-off sections of a vertical well 7 and a horizontal well 11 to a target coal seam, where a drilling fluid circulation pump in a pump group 2 provides drilling fluids for the underground during construction;

2) replacing a drilling tool with a drilling tool 10 and lowering the drilling tool 10 to the kick-off section of the underground horizontal well, performing three-stage reaming and large-diameter well completion on a loose tectonically-deformed coal seam, and forming a horizontal well section that runs through the vertical well 7 (forming a U-shaped well in which the horizontal well adjoins the vertical well), to complete the open-hole cavity-construction, where the drilling fluid circulation pump in the pump group 2 provides the drilling fluids for the underground during construction;

3) removing all drilling tools from the well, lowering an underground injection device 16 to a starting point of the horizontal section of the horizontal well 11, lowering gas-liquid-coal mixture lifting and production devices, namely, a pulverization disturbance device and a hydraulic jet pump 8 to the vertical well 7, and connecting a wellhead of the vertical well 7 to a coal-liquid-gas separation device 5;

4) starting a ground power unit 15, namely, a high-pressure pulse pump in the pump group 2, injecting high-pressure and high-speed fluids into the horizontal section of the horizontal well 11 at a specified frequency, to cut and pulverize a coal rock and implement pressure-pulse excitation and stress release on the horizontal section of the horizontal well 11 to form a depressurization cavity 9, then accelerating water into high-velocity jet flows, to further pulverize and flush coal powder, and conveying a formed gas-liquid-coal mixture to the bottom of the vertical well 7, where during the pressure-pulse excitation and the stress release on the horizontal section of the horizontal well 11, an abrasive mixing device 14 may be connected between a liquid storage tank 3 and the underground injection device 16, and through combined action of a high-pressure mud pump and the high-pressure pulse pump in the pump group 2, an excitation liquid containing an abrasive is injected into the underground, to improve the capability of the excitation liquid to cut a coal rock, thereby improving extraction efficiency;

5) starting the underground pulverization disturbance device and the hydraulic jet pump 8, further pulverizing the coal powder that flows into the bottom of the vertical well 7, and then lifting the coal powder to the ground to enter the coal-liquid-gas separation device 5; and 6) pre-treating the mixture that enters the coal-liquid-gas separation device 5, to enable a coal-liquid mixture and coal bed methane that are separated to respectively enter a coal-liquid separation device 4 and a gas storage tank 6, further treating the coal-liquid mixture that enters the coal-liquid separation device 4, and storing coal powder and a liquid that are separated in a coal powder collection tank 12 and the liquid storage tank 3 respectively.

In step 6), the separated liquid is purified before entering the liquid storage tank 3 to ensure efficient recycling in production.

What is claimed is:

1. A system for extracting gas from a tectonically-deformed coal seam in-situ by depressurizing a horizontal well cavity, comprising a horizontal well drilling and reaming subsystem, a horizontal well hole-collapse cavity-construction depressurization excitation subsystem, a product lifting subsystem, a gas-liquid-solid separation subsystem, and a monitoring and control subsystem, wherein the horizontal well drilling and reaming subsystem includes a drill tower, a drilling rig, a drill column string, a drilling tool, and a drilling fluid circulation system, the drilling tool, extending from a connection end with the drill column string to a drilling end, includes a third-stage reaming and retraction assembly, a primary and secondary reaming and retraction assembly, and a pilot assembly, the third-stage reaming and retraction assembly includes a plurality of expandable and closable blades that are circumferentially disposed about the drilling tool, the primary and secondary reaming and retraction assembly includes a plurality of extendable and retractable plunger drill bits that are circumferentially disposed about the drilling tool;

the horizontal well hole-collapse cavity-construction depressurization excitation subsystem includes a ground power unit and an underground injection device, an inlet of the ground power unit is connected to a liquid storage tank, and an outlet of the ground power unit is connected to the underground injection device, and the underground injection device is disposed at one side of a depressurization cavity in a horizontal well near the drill tower;

the product lifting subsystem includes a pulverization disturbance device and a hydraulic jet pump, the hydraulic jet pump is a wide-flow jet pump and is disposed in a vertical well near a bottom of the well, and the pulverization disturbance device is disposed between the depressurization cavity and the vertical well;

the gas-liquid-solid separation subsystem includes a coal-liquid-gas separation device and a coal-liquid separation device, an inlet of the coal-liquid-gas separation device is connected to a wellhead pipeline of the vertical well, and two outlets of the coal-liquid-gas separation device are connected to a gas storage tank and the coal-liquid separation device respectively, and two outlets of the coal-liquid separation device are connected to a coal powder collection tank and the liquid storage tank respectively; and the monitoring and control subsystem includes three layers of network architecture and software including on-site workstations, monitoring instruments and sensors, and a central server control system, and is configured to detect and control the operation conditions and the execution processes of technical equipment in real time, so as to collect, display, process, and analyze engineering data.

2. The system for extracting gas from a tectonically-deformed coal seam in-situ by depressurizing a horizontal well cavity according to claim 1, wherein the horizontal well hole-collapse cavity-construction depressurization excitation subsystem further includes an abrasive mixing device, an inlet of the abrasive mixing device is connected to the liquid storage tank and an abrasive tank, and an outlet of the abrasive mixing device is connected to the inlet of the ground power unit.

3. The system for extracting gas from a tectonically-deformed coal seam in-situ by depressurizing a horizontal well cavity according to claim 2, wherein a drilling fluid outlet is disposed on the right of the blade, and gradually inclines towards a direction of the blade when extending towards the outer circumference of the drilling tool from an inner cavity of the drilling tool.

4. The system for extracting gas from a tectonically-deformed coal seam in-situ by depressurizing a horizontal well cavity according to claim 3, wherein pumps in the extraction system are all integrated in a pump group except for the hydraulic jet pump.

5. The system for extracting gas from a tectonically-deformed coal seam in-situ by depressurizing a horizontal well cavity according to claim 1, wherein a drilling fluid outlet is disposed on the right of the blade, and gradually inclines towards a direction of the blade when extending towards the outer circumference of the drilling tool from an inner cavity of the drilling tool.

6. The system for extracting gas from a tectonically-deformed coal seam in-situ by depressurizing a horizontal well cavity according to claim 5, wherein pumps in the extraction system are all integrated in a pump group except for the hydraulic jet pump.

* * * * *